US008081117B2

(12) United States Patent
Nagai et al.

(10) Patent No.: US 8,081,117 B2
(45) Date of Patent: Dec. 20, 2011

(54) ANTENNA DEVICE

(75) Inventors: Shuichi Nagai, Kyoto (JP); Hiroyuki Sakai, Kyoto (JP)

(73) Assignee: Panasonic Corporation, Osaka (JP)

( * ) Notice: Subject to any disclaimer, the term of this patent is extended or adjusted under 35 U.S.C. 154(b) by 225 days.

(21) Appl. No.: 12/092,741

(22) PCT Filed: Aug. 4, 2006

(86) PCT No.: PCT/JP2006/315470

§ 371 (c)(1),
(2), (4) Date: May 6, 2008

(87) PCT Pub. No.: WO2007/069367

PCT Pub. Date: Jun. 21, 2007

(65) Prior Publication Data

US 2009/0153433 A1 Jun. 18, 2009

(30) Foreign Application Priority Data

Dec. 12, 2005 (JP) ..... 2005-358219

(51) Int. Cl.
*H01Q 1/38* (2006.01)

(52) U.S. Cl. ..... 343/700 MS; 343/909; 343/756; 343/893

(58) Field of Classification Search ..... 333/104, 333/157, 161, 164, 202, 239, 246, 248; 342/157, 342/158, 356, 360, 368, 371, 372, 375, 376, 342/379, 442, 445, 54; 343/700 MS, 701, 343/702, 711, 720, 721, 729, 742, 744, 748, 343/754, 766, 767, 768, 770, 771, 772, 778, 343/779, 785, 787, 789, 792, 792.5, 793, 343/795, 814, 815, 816, 817, 819, 821, 825, 343/829, 833, 834, 840, 841, 846, 853, 864, 343/866, 872, 873, 876, 893, 895, 909, 911 L, 343/911 R, DIG. 2, 756; 385/1, 12, 129, 385/130, 131, 147, 15, 16, 24, 27, 3, 37, 385/4, 7, 8

See application file for complete search history.

(56) References Cited

U.S. PATENT DOCUMENTS

| | | | | |
|---|---|---|---|---|
| 5,923,225 | A * | 7/1999 | De Los Santos | 333/12 |
| 6,262,495 | B1 | 7/2001 | Yablonovitch et al. | |
| 7,145,518 | B2 | 12/2006 | Tanaka et al. | |
| 2002/0041749 | A1 * | 4/2002 | Johnson et al. | 385/129 |
| 2003/0186725 | A1 | 10/2003 | Miya et al. | |

(Continued)

FOREIGN PATENT DOCUMENTS

| | | |
|---|---|---|
| JP | 4-140905 | 5/1992 |
| JP | 5-11501 | 2/1993 |
| JP | 10-200326 | 7/1998 |
| JP | 2002-510886 | 4/2002 |
| JP | 2003-78337 | 3/2003 |

(Continued)

OTHER PUBLICATIONS

Brown, "Radiation Properties of a Planar Antenna on a Photonic-Crystal Substrate", Journal of the Optical Society of America, vol. 10, No. 2, Feb. 1993, pp. 404-407.*

Xu, "Designing Complex Optical Filters Using Photonic Crystal Microcavities", The International Society for Optical Engineering (SPIE), vol. 5000, 257 (Jul. 29, 2003).*

(Continued)

*Primary Examiner* — Dieu H Duong

(74) *Attorney, Agent, or Firm* — Greenblum & Bernstein, P.L.C.

(57) ABSTRACT

An antenna device according to this invention having: a transmission antenna which is the first antenna element formed on a surface of a substrate; and a receiving antenna which is the second antenna element formed on the surface of the substrate includes a photonic crystal structure between the transmission antenna which is the first antenna element and the receiving antenna which is the second antenna element.

7 Claims, 15 Drawing Sheets

U.S. PATENT DOCUMENTS

| | | | | |
|---|---|---|---|---|
| 2004/0090368 | A1 | 5/2004 | Channabasappa et al. | |
| 2004/0174223 | A1* | 9/2004 | Achyut | 333/1 |
| 2005/0122568 | A1* | 6/2005 | Aoki et al. | 359/321 |
| 2005/0176380 | A1* | 8/2005 | Okabe et al. | 455/73 |
| 2006/0092079 | A1* | 5/2006 | de Rochemont | 343/700 MS |
| 2007/0183515 | A1 | 8/2007 | Lim et al. | |

FOREIGN PATENT DOCUMENTS

| | | |
|---|---|---|
| JP | 2003-289215 | 10/2003 |
| JP | 2003-304113 | 10/2003 |
| JP | 2005-94440 | 4/2005 |
| JP | 2005-110273 | 4/2005 |
| JP | 2005-124056 | 5/2005 |
| JP | 2005-244317 | 9/2005 |
| WO | 99/50929 | 10/1999 |

OTHER PUBLICATIONS

Zhang, "Microstrip Patch Antenna Array on Ground with Circular PBG", Microwave and Optical Technology Letters, vol. 41, Issue 2, pp. 127-130, (Apr. 20, 2004).*

Baracco,"Radiating Element on a Photonic Bandgap Structure for Phased Array Applications", http://www.ctsystemes.com/zeland/publi/284.pdf, (Dec. 13, 2004).*

English language Abstract of JP 10-200326, Jul. 31, 1998.

English language Abstract of JP 2003-304113, Oct. 24, 2003.

English language Abstract of JP 2003-78337, Mar. 14, 2003.

English language Abstract of JP 4-140905, May 14, 1992.

English language Abstract of JP 2005-110273, Apr. 21, 2005.

English language Abstract of JP 2003-289215, Oct. 10, 2003.

English language Abstract of JP 2005-94440, Apr. 7, 2005.

English language Abstract of JP 2005-244317, Sep. 8, 2005.

English language Abstract of JP 2005-124056, May 12, 2005.

U.S. Appl. No. 12/092,739 to Nagai, filed May 6, 2008.

John D. Joannopoulos et al., "Photonic Crystals: Molding the Flow of Light", Princeton University Press, ISBN0-691-03744-2, Jul. 3, 1995, pp. 64-65.

* cited by examiner

ANTENNA DEVICE

TECHNICAL FIELD

The present invention relates to antenna devices, and more particularly to an antenna device which has a plurality of antenna elements on a substrate and which is used for a wireless communication device, a radar device for determining a distance from or a position of an object, or the like.

BACKGROUND ART

There have been examined the radar devices which use millimeter waves or quasi-millimeter waves to realize high-accuracy position determination, aiming for collision prevention in automobile traffic and the like. One example of such radar devices is a pulse radar device which transmits pulse signals by a transmission antenna and detects waves reflected at an object by a receiving antenna. This pulse radar device determines a distance from and a position of the object by calculating a delay difference between the transmitted pulse signal and the received pulse signal.

In such a radar device, isolation between the transmission antenna and the receiving antenna is crucial. The isolation between the transmission antenna and the receiving antenna means a degree of leakage or interference of waves or signals between the transmission antenna and the receiving antenna. The isolation providing less leakage or interference is considered as good isolation.

When signals transmitted from the transmission antenna is leaked into the receiving antenna, a receiving unit which judges signals received by the receiving antenna cannot distinguish the leaked signals from signals reflected at an object. As a result, the leaked signals become noise in the receiving unit, and the receiving unit has a difficulty in detecting the signals reflected at an object. For radar devices, radio field intensity of received waves is quite lower than radio field intensity of transmitted waves. This is because waves which are reflected at an object and received by a radar device are attenuated in proportion to a power of 4 of a distance from the object. For example, when transmitted waves are reflected at a human body 10 m ahead and then return, an attenuation amount of the reflected waves is approximately −90 dB.

A distance within which a radar device can detect an object depends on how much isolation can be established between a transmission antenna and a receiving antenna. Therefore, the isolation between a transmission antenna and a receiving antenna is the most important characteristic to decide radar efficiency.

In recent years, size reduction and low cost have been demanded for radar devices. In order to meet the demand, there has been proposed a radar device in which thin planar microstrip antennas are used as antenna elements and a transmission antenna and a receiving antenna are formed on the same substrate (refer to Patent Reference 1, for example).

FIG. 1 is a plan view showing a structure of a conventional radar device.

The radar device shown in FIG. 1 includes a transmission antenna 1301, a receiving antenna 1302, and a ground conductor 1303.

The ground conductor 1303 is arranged between the transmission antenna 1301 and the receiving antenna 1302, and is electrically connected to ground. By forming the ground conductor 1303, the conventional radar device improves isolation between the transmission antenna and the receiving antenna.

[Patent Reference 1] Japanese Unexamined Patent Application Publication No. 2005-94440

DISCLOSURE OF INVENTION

Problems that Invention is to Solve

However, the conventional radar device has a problem that the isolation between the transmission antenna and the receiving antenna is not satisfactory.

In view of the above problem, an object of the present invention is to provide an antenna device having good isolation between a transmission antenna and a receiving antenna.

Means to Solve the Problems

In accordance with an aspect of the present invention for achieving the above object, there is provided an antenna device including: a first antenna element formed on a surface of a substrate; a second antenna element formed on the surface of the substrate; and a photonic crystal structure formed between the first antenna element and the second antenna element.

With the above structure, in the antenna device according to the present invention, the photonic crystal structure formed between the first antenna element and the second antenna element reduces wave leakage between the first antenna element and the second antenna element. That is, when the first antenna element is used as a transmission antenna and the second antenna element is used as a receiving antenna, the antenna device according to the present invention can achieve good isolation between the transmission antenna and the receiving antenna.

Furthermore, the photonic crystal structure may include a part of the substrate.

With the above structure, by forming the photonic crystal structure on the substrate, the antenna device according to the present invention can reduce wave leakage between the first antenna element and the second antenna element.

Still further, the antenna device may further include a ground conductor on a rear surface of the substrate, wherein the photonic crystal structure includes a part of the ground conductor.

With the above structure, by forming the photonic crystal structure on the ground conductor, the antenna device according to the present invention can reduce wave leakage between the first antenna element and the second antenna element.

Still further, the antenna device may further include a top surface conductor formed on a surface of the substrate between the first antenna element and the second antenna element, wherein the top surface conductor is electrically connected to ground.

With the above structure, by forming the top surface conductor, the antenna device according to the present invention can reduce wave leakage between the first antenna element and the second antenna element.

Still further, the photonic crystal structure may include a part of the top surface conductor.

With the above structure, by forming the photonic crystal structure on the top surface conductor, the antenna device according to the present invention can reduce wave leakage between the first antenna element and the second antenna element.

Still further, the antenna device may further include a plurality of throughholes arranged at equal spaces in the substrate, wherein the photonic crystal structure includes the plurality of throughholes.

With the above structure, in the antenna device according to the present invention, by forming the throughholes on the substrate, it is possible to easily realize the photonic crystal structure.

Still further, the photonic crystal structure may be made of (i) a substance of the substrate and (ii) a substance different from the substance of the substrate.

With the above structure, in the antenna device according to the present invention, by increasing a difference of a refraction index between two substances of the photonic crystal structure, it is possible to reduce a region in which the photonic crystal structure is formed. As a result, it is possible to reduce a size of the antenna device according to the present invention. In addition, the formed photonic crystal structure can thereby block waves of a wide frequency band.

Still further, the substance different from the substance of the substrate may be a wave absorber.

With the above structure, in the antenna device according to the present invention, the wave absorber absorbs waves which are leaked between the first antenna element and the second antenna element, and converts the leaked waves into heat. As a result, the antenna device according to the present invention can improve the isolation between the first antenna element and the second antenna element.

Still further, a dielectric loss tangent of the substance different from the substance of the substrate may be greater than a dielectric loss tangent of the substance of the substrate.

With the above structure, the antenna device according to the present invention can improve the isolation between the first antenna element and the second antenna element.

Still further, the substance different from the substance of the substrate may protrude from the surface of the substrate.

With the above structure, in the antenna device according to the present invention, by forming the photonic crystal structure on a surface of the substrate, it is possible to block waves leaked above a surface of the substrate.

Still further, a frequency band which is blocked by the photonic crystal structure may include a frequency band of a wave which is transmitted or received by at least one of the first antenna element and the second antenna element.

With the above structure, by forming the photonic crystal structure, the antenna device according to the present invention can reduce wave leakage between the first antenna element and the second antenna element, regarding waves which are used in least one of the first antenna element and the second antenna element.

In accordance with another aspect of the present invention, there is provided an antenna device including: a first antenna element formed on a surface of a substrate; a second antenna element formed on the surface of the substrate; and a ground conductor on a rear surface of the substrate, wherein the ground conductor has a gap between the first antenna element and the second antenna element.

With the above structure, the antenna device according to the present invention can reduce waves which are leaked between the first antenna element and the second antenna element through the ground conductor. As a result, the antenna device according to the present invention can improve the isolation between the first antenna element and the second antenna element.

Furthermore, the ground conductor may include: a first ground conductor formed on a region of a rear surface of the substrate, on the region being formed the first antenna element; a second ground conductor formed on another region of the rear surface of the substrate, on the another region being formed the second antenna element; and a connection line electrically connecting the first ground conductor to the second ground conductor, wherein the first ground conductor and the second ground conductor are formed with the gap being positioned between the first ground conductor and the second ground conductor.

With the above structure, in the antenna device according to the present invention, it is possible to electrically connect the first ground conductor to the second ground conductor.

Still further, the connection line may be a serpentine line formed on the rear surface of the substrate.

With the above structure, the antenna device according to the present invention can extend a line length of the connection line. As a result, the antenna device according to the present invention can reduce waves which are leaked through the connection line between the first antenna element and the second antenna element.

In accordance with still another aspect of the present invention, there is provided an antenna device including: a first antenna element formed on a surface of a substrate; a second antenna element formed on the surface of the substrate; and a wave absorber between the first antenna element and the second antenna element.

With the above structure, in the antenna device according to the present invention, the waves leakage between the first antenna element and the second antenna element are absorbed and then converted into heat by the wave absorber. As a result, the antenna device according to the present invention can improve the isolation between the first antenna element and the second antenna element.

Effects of the Invention

The present invention can provide an antenna device having good isolation between a transmission antenna and a receiving antenna.

NUMERICAL REFERENCES

Figure 1:
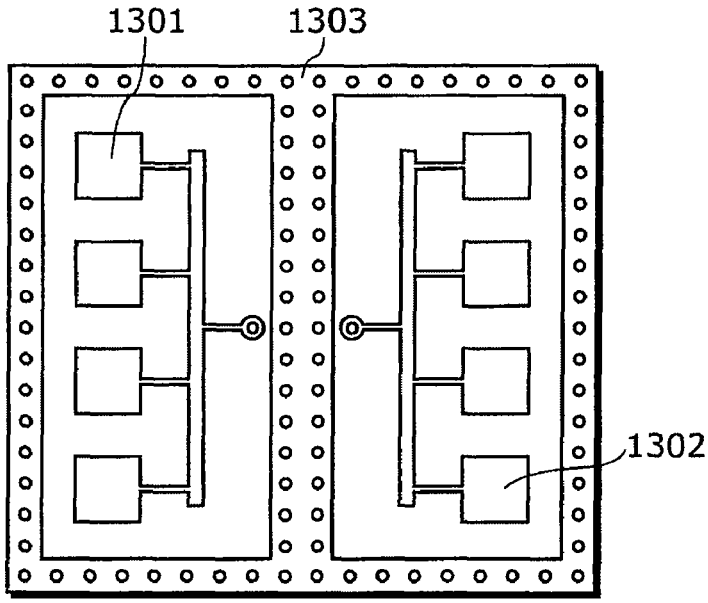
PRIOR ART FIG. 1
FIG. 1 is a plane view of the conventional antenna device.

101 transmission antenna
102 receiving antenna
103 substrate
104 ground conductor
105, 306 throughhole
110, 310, 410, 510, 610, 710, 711, 810, 910 photonic crystal structure
407 top surface conductor
408 connection conductor
509, 609, 709 hole
1110 wave absorber
1220 connection line
1230 connection serpentine line
a arrangement space between throughholes
r, r1, r2 radius of throughhole

BEST MODE FOR CARRYING OUT THE INVENTION

The following describes preferred embodiments of the antenna device according to the present invention with reference to the drawings.

First Embodiment

The antenna device according to the first embodiment can achieve good isolation between a transmission antenna and a receiving antenna, by forming a photonic crystal structure between the transmission antenna and the receiving antenna.

Figure 2A:
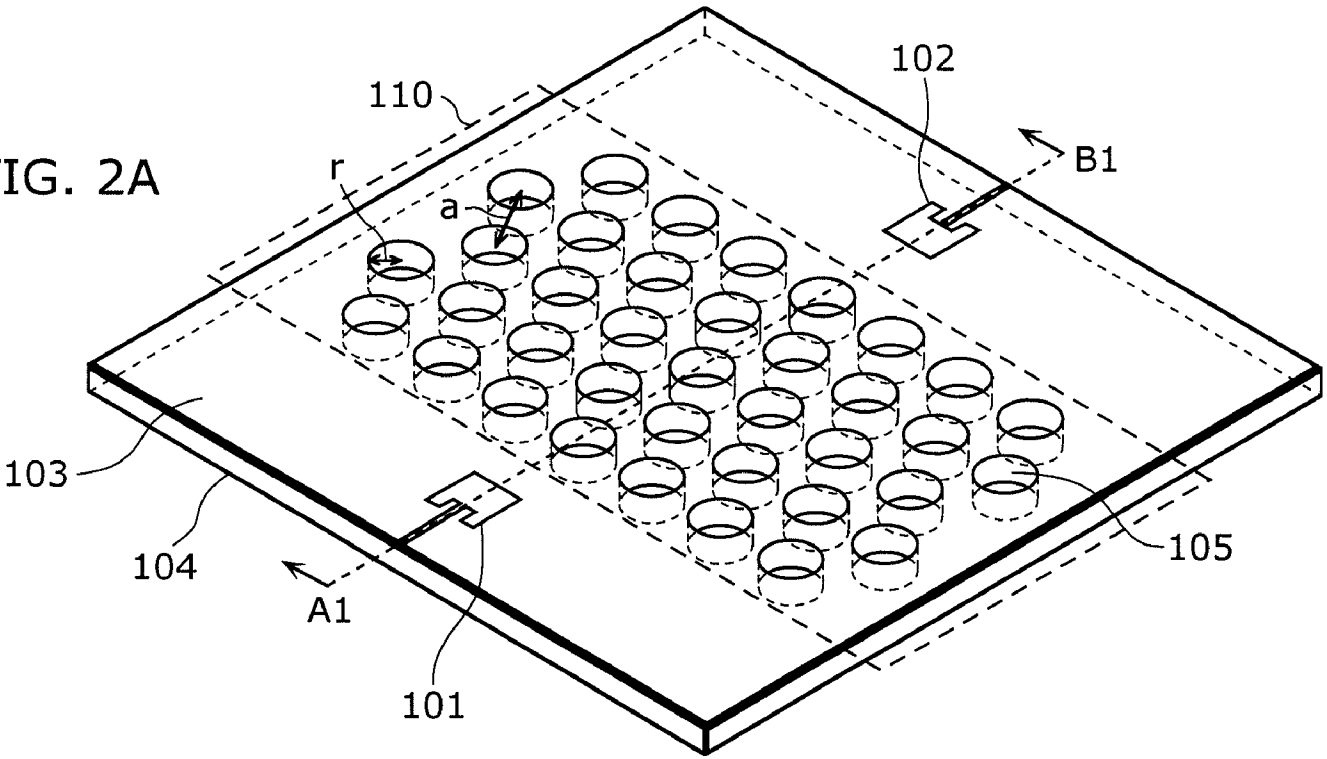
FIG. 2A is a perspective view of an antenna device according to the first embodiment.
Figure 2B:
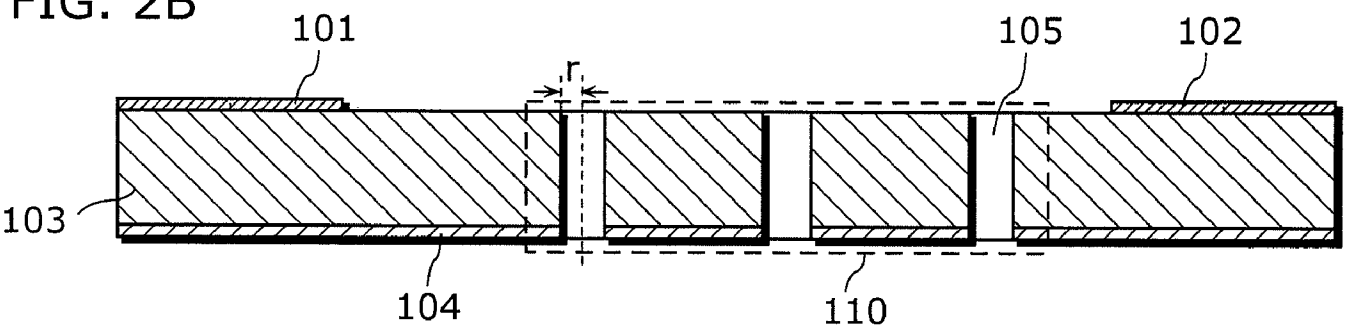
FIG. 2B is a cross sectional view taken along line A1-B1 of FIG. 2A.

FIG. 2A is a perspective view of the antenna device according to the first embodiment of the present invention. FIG. 2B is a cross sectional view taken along line A1-B1 of FIG. 2A.

As shown in FIGS. 2A and 2B, the antenna device according to the first embodiment includes a substrate 103, a transmission antenna 101, a receiving antenna 102, a ground conductor 104, and a photonic crystal structure 110.

The substrate 103 is a monolayer substrate made of dielectric substance such as Teflon™.

The transmission antenna 101 is the first antenna element formed on a surface of the substrate 103, and transmits radio waves.

The receiving antenna 102 is the second antenna element formed on the surface of the substrate 103, and receives radio waves which have been transmitted from the transmission antenna 101 and then reflected at an object. For example, each of the transmission antenna 101 and the receiving antenna 102 is a planar microstrip patch antenna. Here, a structure of feeding power to the transmission antenna 101 and the receiving antenna 102 employs a coplanar feeding scheme, forming a feed line and these antenna elements on the same plane.

The ground conductor 104 is a conductor formed on a rear surface of the substrate 103, and is electrically connected to ground.

The photonic crystal structure 110 is formed between the transmission antenna 101 and the receiving antenna 102 to block waves of a specific frequency band. The photonic crystal structure 110 includes a plurality of throughholes 105. The photonic crystal structure 110 is a two-dimensional photonic crystal structure.

The plurality of throughholes 105 are arranged at equal spaces on the substrate 103. As shown in FIGS. 2A and 2B, the circular throughholes 105 each having radius r are arranged at equal spaces a on the substrate 103. Moreover, on the ground conductor 104, a plurality of circular parts each having radius r arranged at equal spaces a are removed. In other words, a part of the substrate 103 and a part of the ground conductor 104 form the photonic crystal structure 110. For example, the radius r is approximately 1.45 mm, and the space a is approximately 3.0 mm. The plurality of throughholes 105 are formed by piercing the substrate 103 using a drill or the like.

Figure 3A:
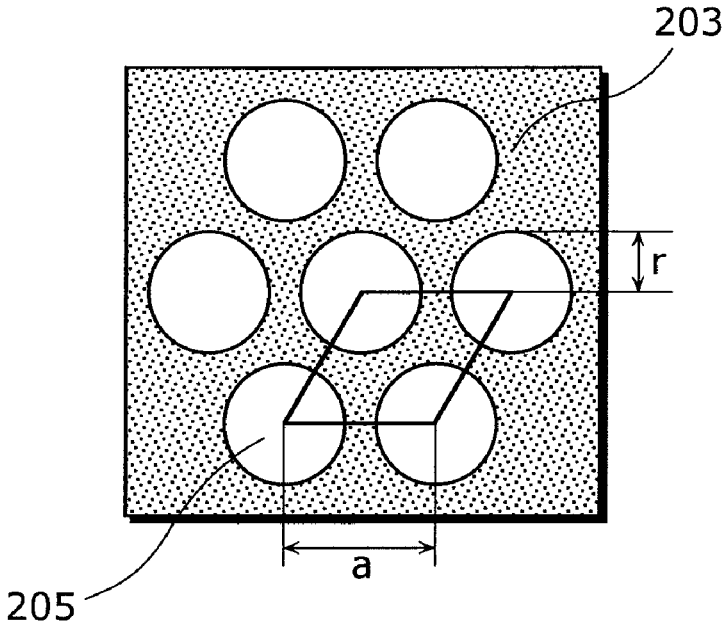
FIG. 3A is a plane view of a photonic crystal structure.
Figure 3B:
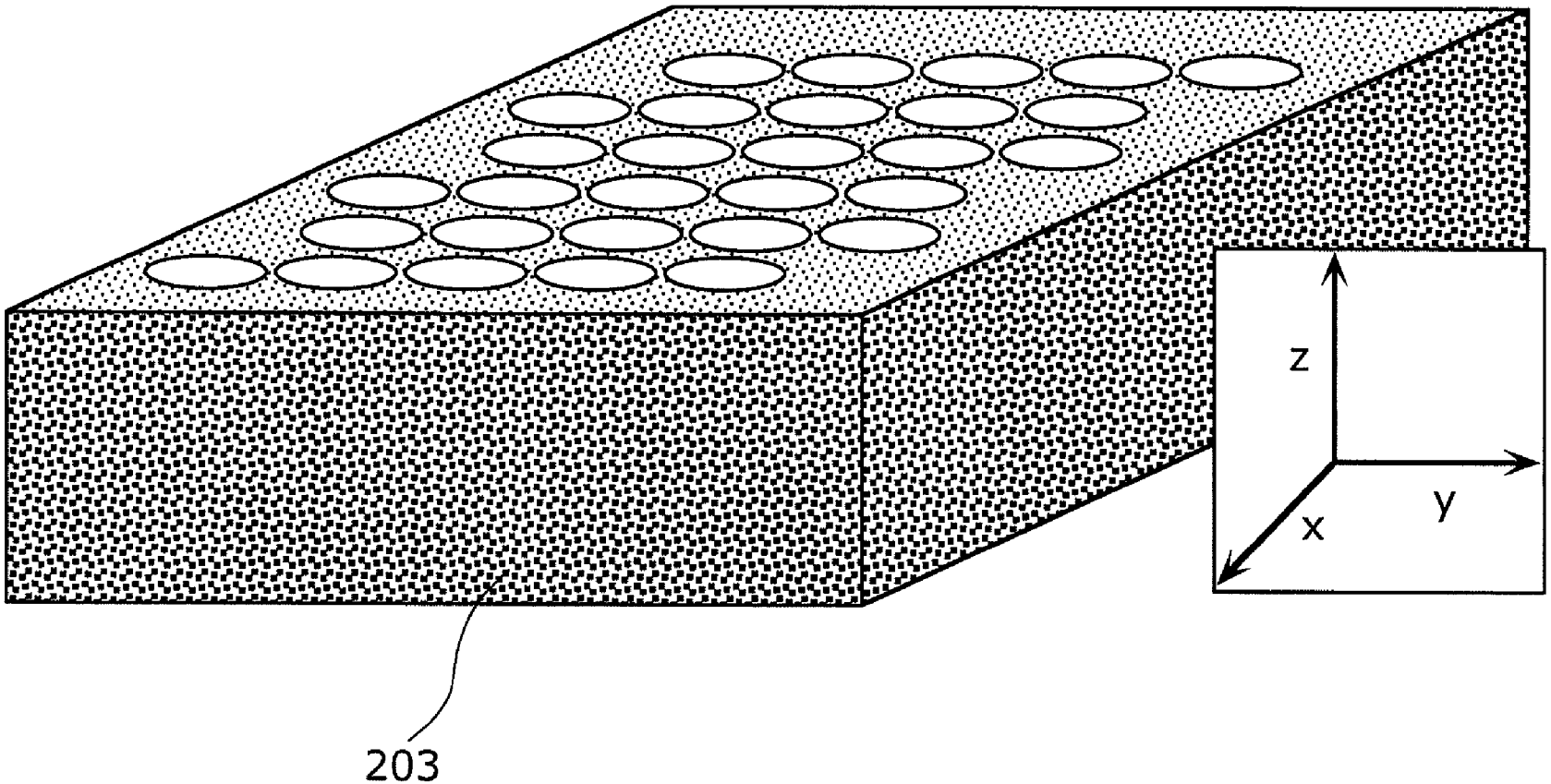
FIG. 3B is a perspective view of the photonic crystal structure.
Figure 3C:
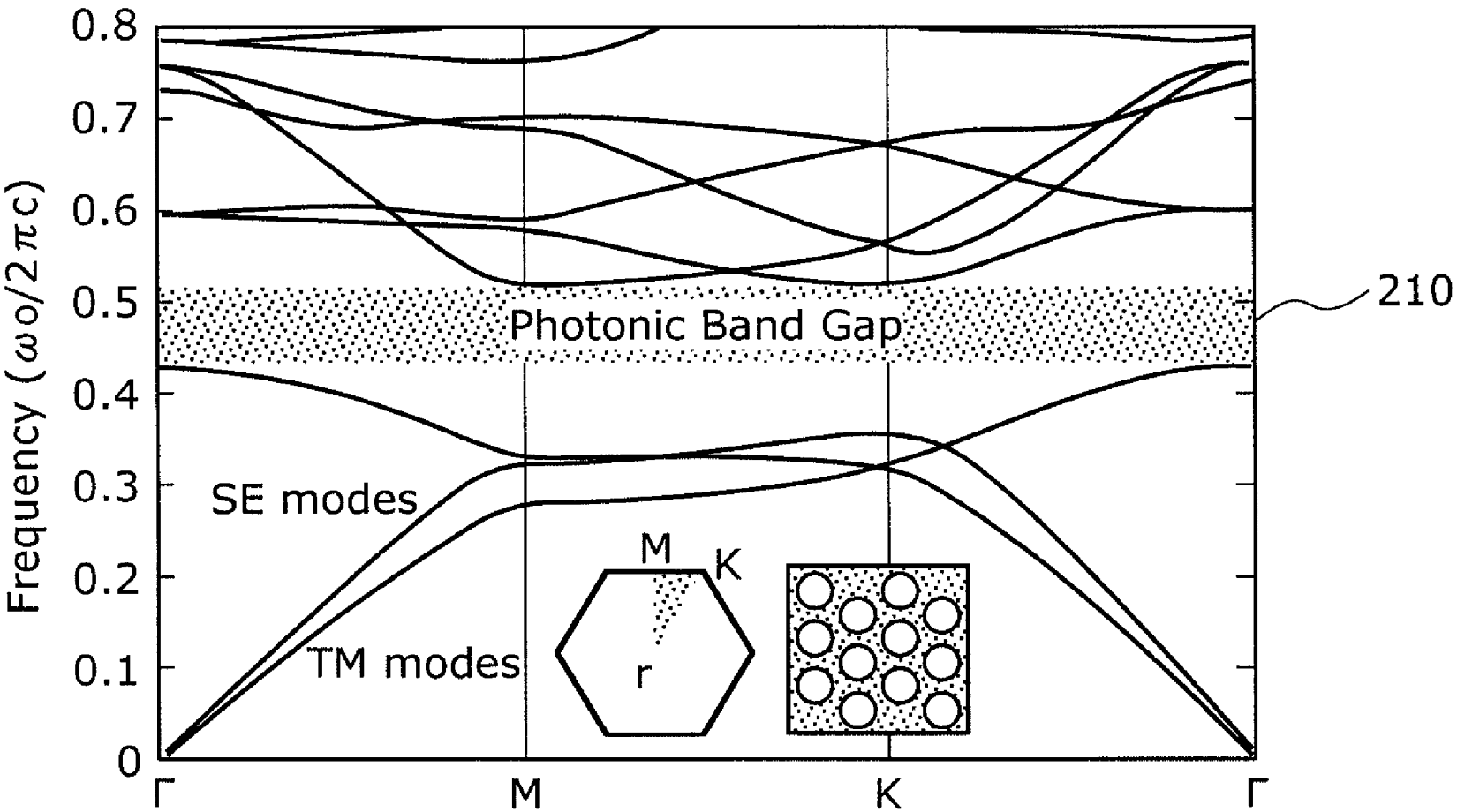
FIG. 3C is a graph plotting dispersion characteristics of the photonic crystal structure versus a frequency.

The following describes the photonic crystal structure with reference to FIGS. 3A, 3B, and 3C.

FIG. 3A is a plane view of the two-dimensional photonic crystal structure. FIG. 3B is a perspective view of the two-dimensional photonic crystal structure.

As shown in FIGS. 3A and 3B, the photonic crystal structure has a structure in which dielectric substance or a semiconductor forms a lattice pattern such as a crystal lattice. In the photonic crystal structure shown in FIGS. 3A and 3B, a plurality of throughholes 205 are arranged at equal spaces on the substrate 203. Here, the throughholes 205 are arranged at spaces a, and each of the throughhole 205 has a radius r. In the photonic crystal structure, two kinds of substances having different refraction indexes are arranged at equal spaces. For example, in the first embodiment, the two kinds of substances of the photonic crystal structure 110 are dielectric substance which is substance of the substrate 103 and air. In short, the photonic crystal structure 110 is made of the substance of the substrate 103 and air. Like a crystal lattice, such a structure having refractive-index dispersion at a regular pattern has a specific frequency band, and waves of the specific frequency band cannot be propagated or passed in all directions in the structure. The two-dimensional photonic Crystal structure is a photonic crystal structure in which an arrangement pattern is arranged two-dimensionally as shown in FIGS. 3A and 3B (for more detail, refer to "Photonic Crystals: molding the flow of light", John D. Joannopulos, et al., Princeton University Press, ISBN0-691-03744-2).

FIG. 3C shows dispersion characteristics versus wave number vectors Γ, M, and K, regarding the photonic crystal structure where r/a=0.48, in the cases of FIGS. 3A and 3B. As shown in FIG. 3C, in the photonic crystal structure, in all directions from the Γ, M, and K positions, waves having a normalized frequency ($\omega a/2\pi C$, where ω is an angular frequency and C is a light speed) from 0.45 to 0.51 cannot exist. This frequency band is herein called a photonic band gap 210.

In the antenna device according to the first embodiment, the photonic band gap 210 of the photonic crystal structure 110 between the transmission antenna 101 and the receiving antenna 102 is formed to have the same frequency band as a frequency band of waves to be transmitted and received. In other words, the frequency band which is blocked by the photonic crystal structure 110 includes a frequency band of waves which are transmitted or received by the receiving antenna 101 and the transmission antenna 102. Thereby, wave leakage can be prevented in all directions between the transmission antenna 101 and the receiving antenna 102. As a result, the antenna device according to the first embodiment can achieve good isolation between the transmission antenna and the receiving antenna.

In the meanwhile, the photonic band gap 210 exists near a frequency f determined by the following equation (1).

$$f\ [\mathrm{Hz}] = \frac{c}{2a \times n_{eq}} \qquad \text{Equation (1)}$$

$$n_{eq} = n_0\left(\frac{2r}{a}\right) + n_1\left(1 - \frac{2r}{a}\right)$$

In the equation (1), c represents a light speed, $n_{eq}$ represents an equivalent refractive index, r represents a radius of the throughhole 205, a represents an arrangement space of the throughhole 205, $n_0$ represents a refractive index of the throughhole 205 (air in the first embodiment), and $n_1$ represents a refractive index of the substrate 205.

As obvious from the equation (1), by changing the radium r of the throughhole 205 and the arrangement space a of the throughhole 205, it is possible to change the frequency band of the photonic band gap 210. In other words, by changing the radium r of the throughhole 205 and the arrangement space a of the throughhole 205, it is possible to form the photonic crystal structure 110 having the photonic band gap 210 corresponding to a frequency of waves to be transmitted and received by the antenna device. Here, the frequency band of the photonic band gap 210 varies depending on a difference of refractive indexes between substances of the photonic crystal structure.

As described above, in the antenna device according to the first embodiment, the photonic crystal structure 110 is formed by forming a plurality of throughholes between the transmission antenna 101 and the receiving antenna 102. The photonic crystal structure 110 has the photonic band gap 210 including a frequency of waves used by the transmission antenna 101 and the receiving antenna 102. Thereby, the antenna device according to the first embodiment can prevent wave leakage between the transmission antenna 101 and the receiving antenna 102. As a result, the antenna device according to the first embodiment can achieve good isolation between the transmission antenna and the receiving antenna.

Although the above has described the antenna device according to the first embodiment, the present invention is not limited to this embodiment.

For example, it should be noted that each of the elements (throughholes 105) of the photonic crystal structure 110 has been described to have a circular shape, but each throughhole 105 may be formed to have a polygonal shape or an ellipse shape.

It should also be noted that it has described that the throughholes 105 are arranged in a lattice pattern on the dielectric substrate 103 thereby realizing the photonic crystal structure 110, but, on the other hand, the photonic crystal structure may be realized by leaving parts of the dielectric substrate 103 in a lattice pattern.

It should also be noted that the photonic crystal structure 110 has been described to be a two-dimensional photonic crystal structure, but the photonic crystal structure 110 may be a three-dimensional photonic crystal structure.

It should also be noted that each of the transmission antenna 101 and the receiving antenna 102 has been described to be a planar microstrip patch antenna, but these antennas may be any antennas having other structures. Furthermore, each of the transmission antenna 101 and the receiving antenna 102 may have an array antenna structure. Still further, although the feeding scheme for the transmission antenna 101 and the receiving antenna 102 has been described to be the coplanar feeding scheme, the scheme may be any other schemes such a slot feeding scheme.

It should also be noted that the substrate 103 has been described to be a substrate made of dielectric substance, but the substrate 103 may be a substrate made of other substances, such as an alumina substrate or a ceramic substrate. Furthermore, although the substrate 103 has been described to be a monolayer substrate, the substrate 103 may be a multilayer substrate.

It should also be noted that the arrangement of the throughholes 105 has described to be an lattice pattern, but the arrangement may be any other arrangement.

It should also be noted that the antenna device has been described to have two elements of the transmission antenna 101 and the receiving antenna 102, but the antenna device may have two or more antenna elements. Moreover, the antenna device may have only one antenna element. If the antenna device has only one antenna device, the photonic crystal structure surrounds the antenna element to prevent unnecessary leakage from the antenna element. Here, by surrounding the antenna element by the photonic crystal structure, it is also possible to prevent noise into the antenna element. Even if the antenna device has two or more antenna elements, the photonic crystal structure can surround the antenna elements.

It should also be noted that the throughholes 105 have been described to pierce the substrate 103 and the ground conductor 104, but it is also possible that the throughholes 105 pierce only the substrate 103 and the ground conductor 104 does not have any holes.

Second Embodiment

In the antenna device according to the second embodiment, a photonic crystal structure is realized by filling each of the plurality of throughholes 105 of FIGS. 2A and 2B with a substance different from the substance of the substrate 103.

Figure 4A:
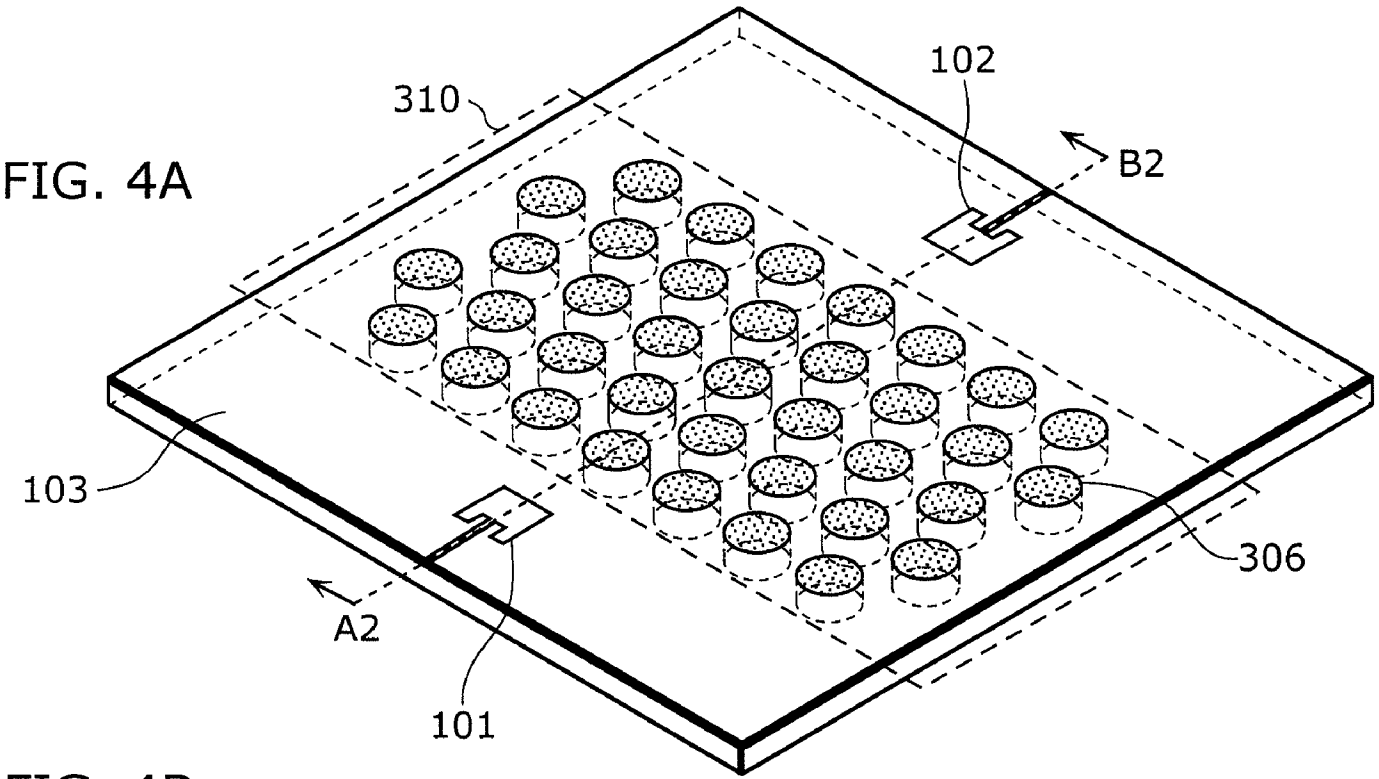
FIG. 4A is a perspective view of an antenna device according to the second embodiment.
Figure 4B:
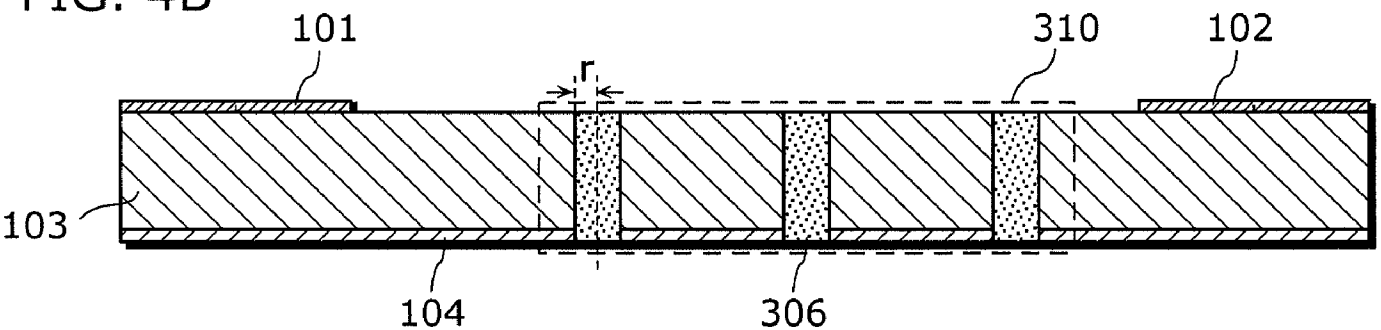
FIG. 4B is a cross sectional view taken along line A2-B2 of FIG. 4A.

FIG. 4A is a perspective view showing a structure of the antenna device according to the second embodiment. FIG. 4B is a cross sectional view taken along line A2-B2 of FIG. 4A. Here, the same reference numerals of FIGS. 2A and 2B are assigned to identical elements of FIGS. 4A and 4B, so that the detailed explanation for the identical elements is not given again below.

As shown in FIGS. 4A and 4B, the antenna device according to the second embodiment includes a photonic crystal structure 310 having a plurality of throughholes 306.

The plurality of throughholes 306 are formed between the transmission antenna 101 and the receiving antenna 102. Each of the plurality of throughholes 306 is filled with a filling of a substance different from the substance of the substrate 103. This means that the photonic crystal structure 310 is made of the substance of the substrate 103 and a substance different from the substance of the substrate 103. The substance of the fillings used for the throughholes 306 has a refraction index (relative permittivity) greater than a refraction index (relative permittivity) of the substance of the substrate 103. For example, the fillings used for the throughholes 306 are made of silicon resin or the like.

With the above structure, in the antenna device according to the second embodiment, even if the space a for arranging the throughholes 306 is shorter than the space a of the antenna device according to the first embodiment, it is possible to form the photonic band gap 210 having the same frequency band as the first embodiment. As a result, it is possible to reduce a size of the photonic crystal structure 310. In addition, in the antenna device according to the second embodiment, by increasing a difference of refraction indexes between substances of the photonic crystal structure 310, it is possible to form the photonic crystal structure 310 having the photonic band gap 210 of a wide frequency band. As a result, the antenna device using a wide frequency range can improve isolation between the transmission antenna and the receiving antenna.

It should be noted that the substance of the fillings for the throughholes 306 may be a wave absorber which can absorb waves. Thereby, it is possible to attenuate waves propagated between the transmission antenna 101 and the receiving antenna 102. As a result, the isolation between the transmission antenna and the receiving antenna can be further improved. For example, the substance of the wave absorber for the throughholes 306 is a substance which converts waves into heat using a carbon resistance loss, a magnetism loss of ferrite or the like. Still further, the same effects can be achieved, when a substance having a dielectric loss tangent greater than a dielectric loss tangent of dielectric substance which is a substance of the substrate 103 is used as the fillings for the throughholes 306.

It should also be noted that it has been described that the throughholes 305 are arranged in a lattice pattern on the dielectric substrate 103 and then filled with the fillings to form the photonic crystal structure, but, on the other hand, the photonic crystal structure may be formed by leaving parts of the dielectric substrate 103 in a lattice pattern and a part except the parts of the dielectric substance 103 are filled with the fillings.

Third Embodiment

The antenna device according to the third embodiment can achieve high isolation between the transmission antenna and the receiving antenna, by further including a ground conductor formed on a surface of the substrate 103 in the antenna device according to the second embodiment.

Figure 5A:
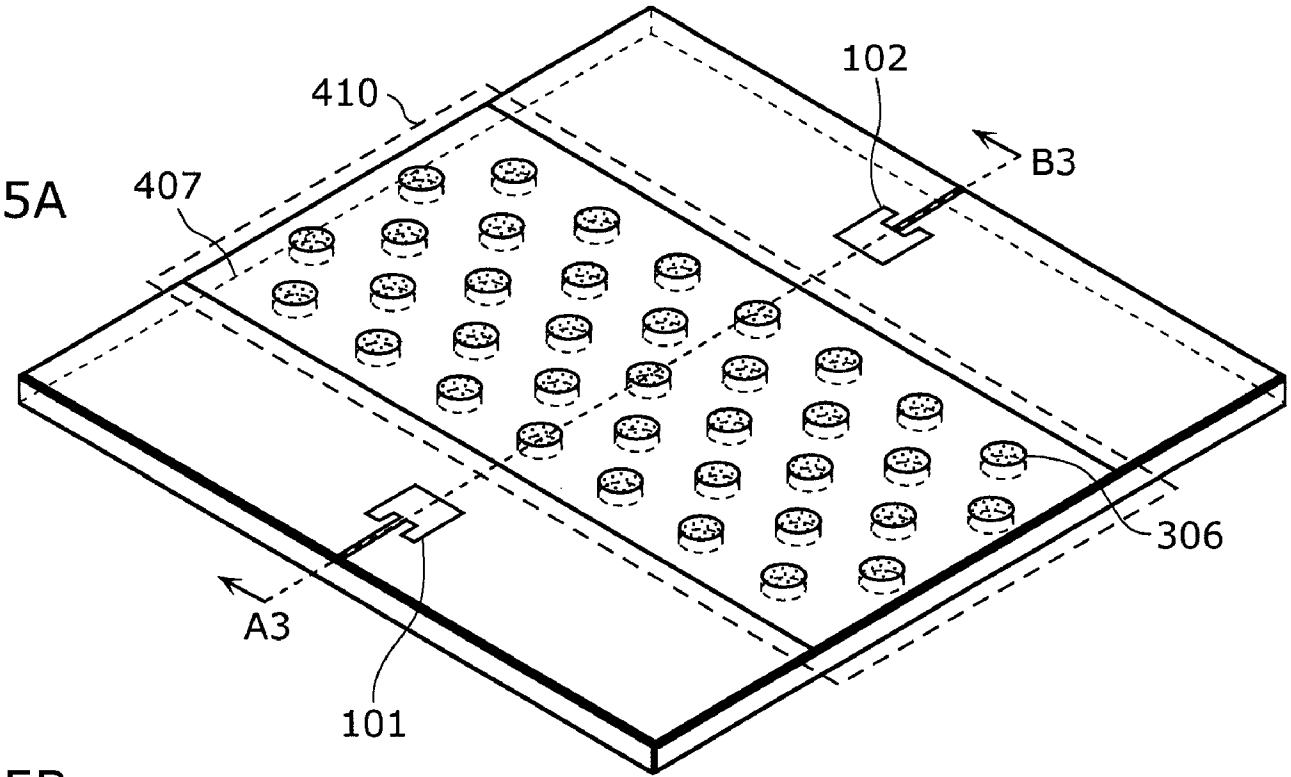
FIG. 5A is a perspective view of an antenna device according to the third embodiment.
Figure 5B:
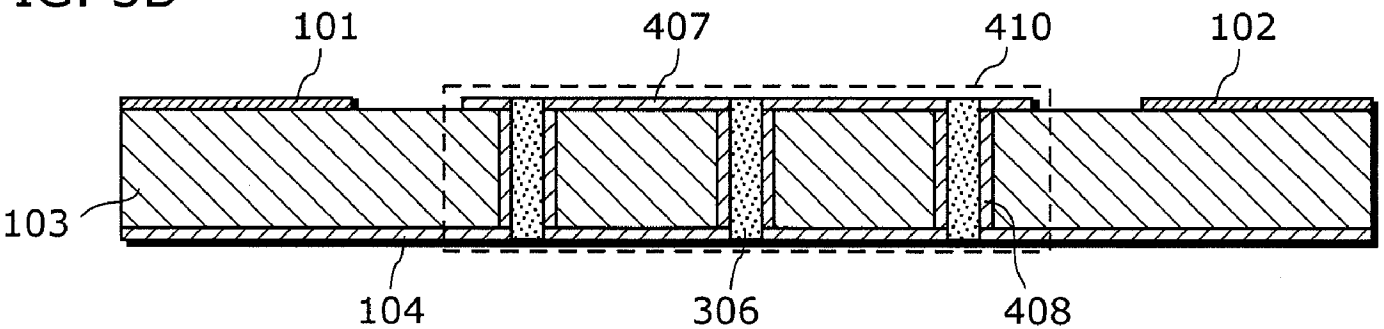
FIG. 5B is a cross sectional view taken along line A3-B3 of FIG. 5A.

FIG. 5A is a perspective view showing a structure of the antenna device according to the third embodiment. FIG. 5B is a cross sectional view taken along line A3-B3 of FIG. 5A. Here, the same reference numerals of FIGS. 4A and 4B are assigned to identical elements of FIGS. 5A and 5B, so that the detailed explanation for the identical elements is not given again below.

The antenna device shown in FIGS. 5A and 5B differs from the antenna device according to the second embodiment in including the a top surface conductor 407 and a connection conductor 408.

The top surface conductor 407 is formed on a surface of the substrate 103 between the transmission antenna 101 and the receiving antenna 102.

The connection conductor 408 is formed on an entire internal surface of each of the throughholes 306. After forming the throughholes, the inside of each of the throughholes 306 is plated, thereby forming the connection conductor 408. Then, after forming the connection conductor 408, each of the throughholes 306 is filled with a filling. The connection conductor 408 is contact to the ground conductor 104 and the top surface conductor 407. Therefore, the ground conductor 104, the top surface conductor 407, and the connection conductor 408 are electrically connected to ground.

In addition, the top surface conductor 407 has holes with the same shape of the throughholes 306 formed on the substrate 103. This means that a part of the substrate 103, a part of the ground conductor 104, and a part of the top surface conductor 407 form a photonic crystal structure 410.

With the above structure, the antenna device according to the third embodiment can improve isolation between the transmission antenna 101 and the receiving antenna 102, by forming the top surface conductor 407 on a top surface of the substrate 103 and the connection conductor 408 inside of each of the throughholes 306.

It should be noted that it has been described that the photonic crystal structure 410 is formed in all of the throughholes 306, the ground conductors 104, and the top surface conductor 407, but the third embodiment is not limited to the above.

Figure 6A:
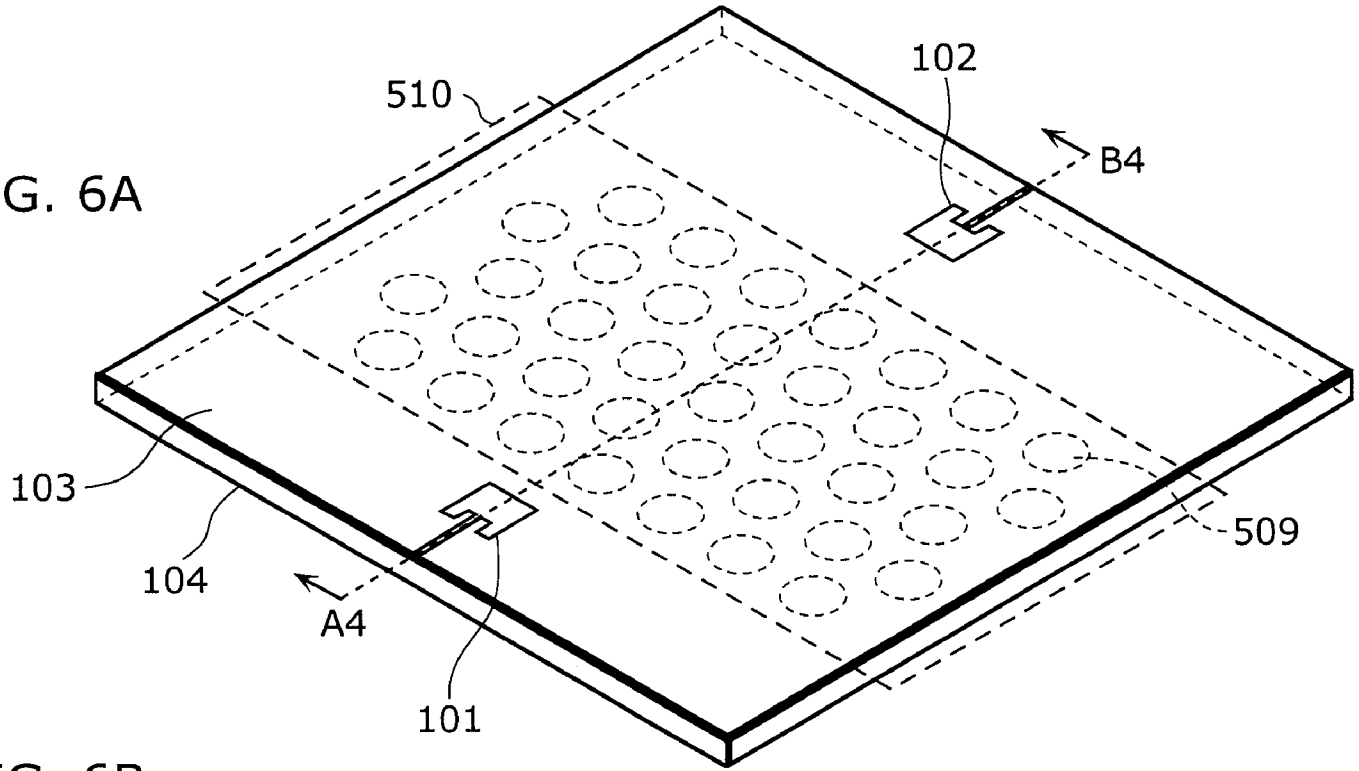
FIG. 6A is a perspective view of an antenna device in which a photonic crystal structure is formed only in a ground conductor.
Figure 6B:
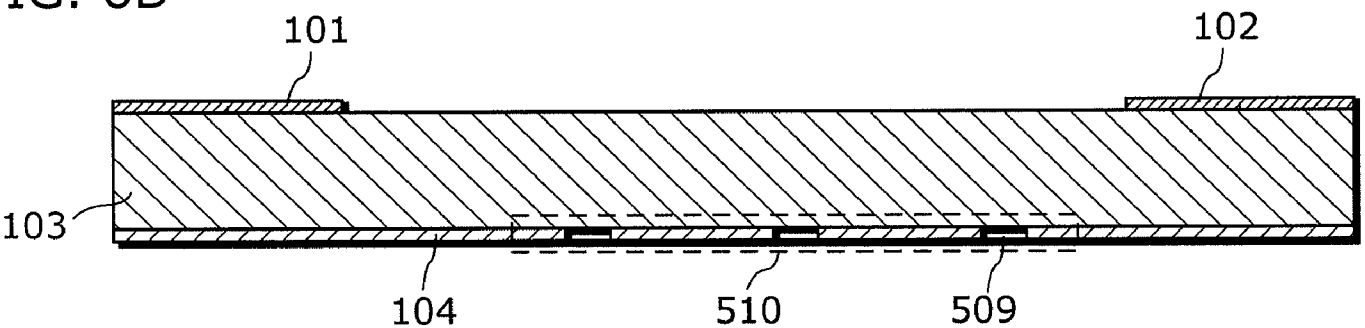
FIG. 6B is a cross sectional view taken along line A4-B4 of FIG. 6A.

FIG. 6A is a perspective view of an antenna device in which a photonic crystal structure 510 is formed only in the ground conductor 104. FIG. 6B is a cross sectional view taken along line A4-B4 of FIG. 6A. As shown in FIGS. 6A and 6B, the photonic crystal structure 510 may be realized by forming circular holes 509 only in the ground conductor 104.

Figure 7A:
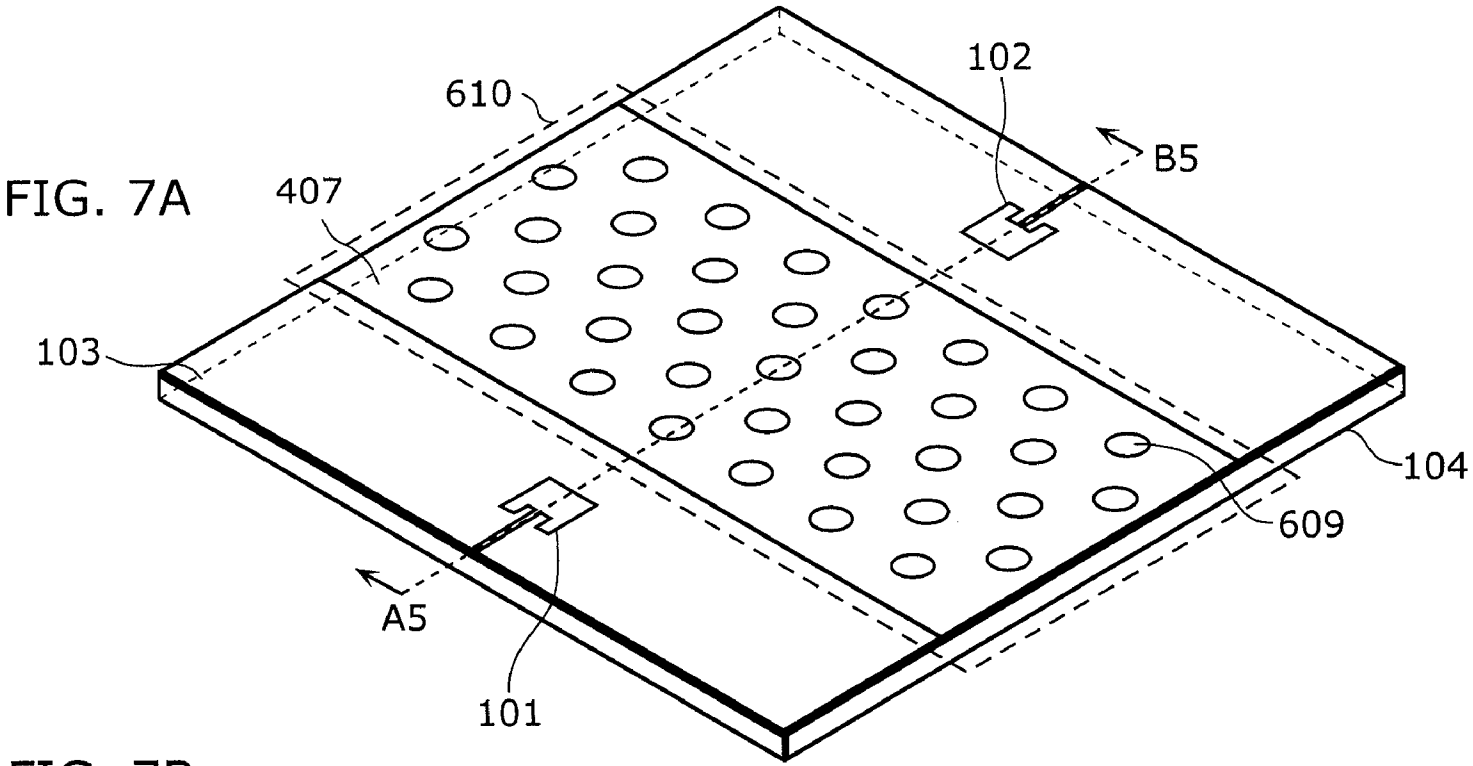
FIG. 7A is a perspective view of an antenna device in which a photonic crystal structure is formed only in a top surface conductor.
Figure 7B:
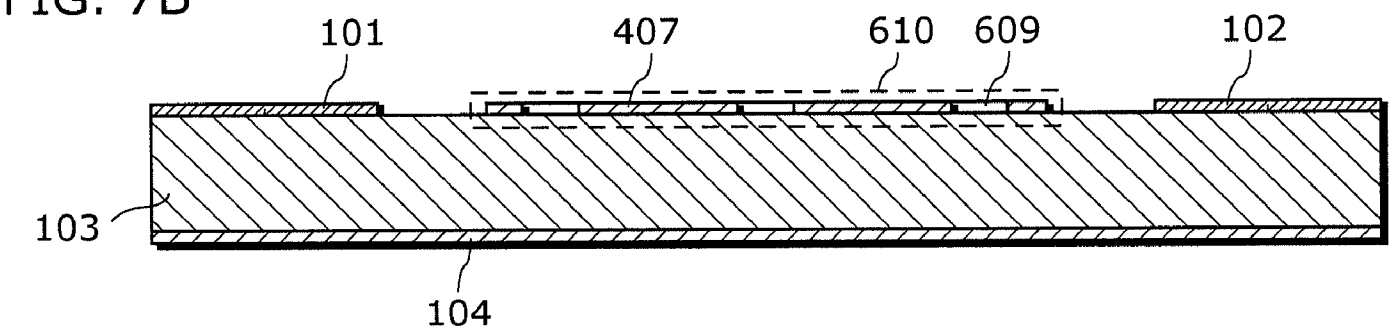
FIG. 7B is a cross sectional view taken along line A5-B5 of FIG. 7A.

FIG. 7A is a perspective view of an antenna device in which a photonic crystal structure 610 is formed only in a conductor 104 formed on a surface of the substrate 103. FIG. 7B is a cross sectional view taken along line A5-B5 of FIG. 7A. As shown in FIGS. 7A and 7B, the photonic crystal structure 610 may be realized by forming circular holes 609 only in the top surface conductor 407.

Fourth Embodiment

In the antenna device according to the fourth embodiment, the ground conductor 104 has a photonic crystal structure which has an arrangement pattern different from the arrangement pattern of the photonic crystal structure formed on the substrate 103.

Figure 8A:
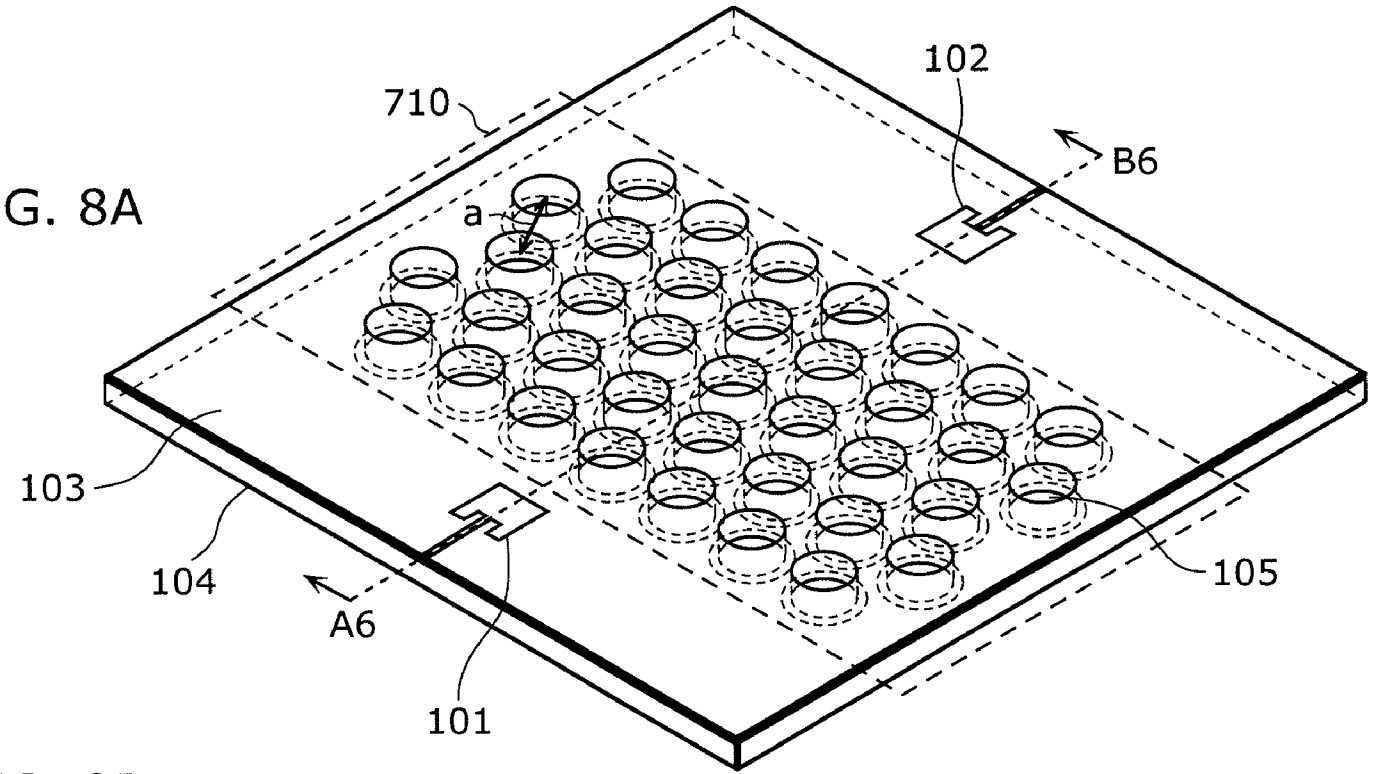
FIG. 8A is a perspective view of an antenna device according to the fourth embodiment.
Figure 8B:
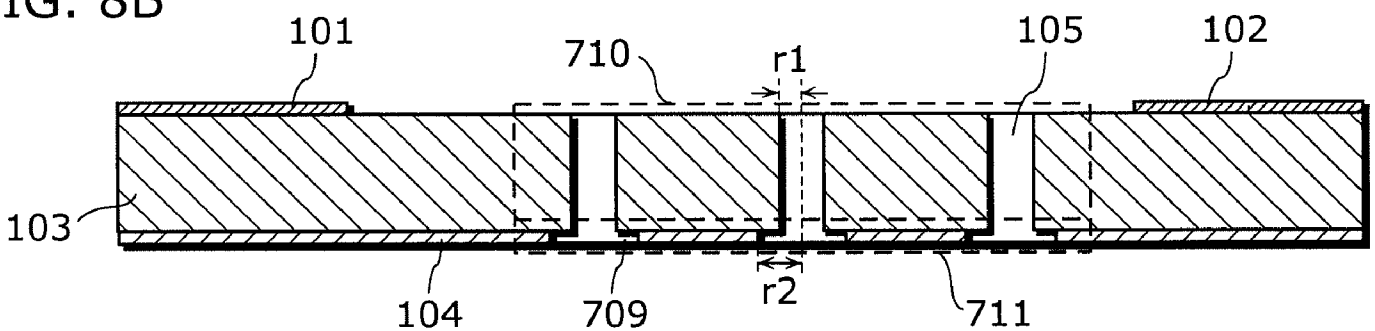
FIG. 8B is a cross sectional view taken along line A6-B6 of FIG. 8A.

FIG. 8A is a perspective view showing a structure of the antenna device according to the fourth embodiment. FIG. 8B is a cross sectional view taken along line A6-B6 of FIG. 8A. Here, the same reference numerals of FIGS. 2A and 2B are assigned to identical elements of FIGS. 8A and 8B, so that the detailed explanation for the identical elements is not given again below.

As shown in FIGS. 8A and 8B, a radius r1 of each of the plurality of throughholes 105 is different from a radius r2 of each of a plurality of holes 709 which are formed in the ground conductor 104. This means that a photonic crystal structure 720 having an arrangement pattern different from a arrangement pattern of a photonic crystal structure 710 formed on the substrate 103 is formed. Here, the arrangement pattern of the photonic crystal structure is determined by an arrangement space a, a radius, a shape (circular or polygonal, for example), and the like of the throughhole 105. Since the refraction index of the substrate 103 is different from the refraction index of the ground conductor 104, when the photonic crystal structure 710 and the photonic crystal structure 720 have the same arrangement pattern, a frequency band (photonic band gap 210) which the photonic crystal structure 710 can block becomes different from a frequency band (photonic band gap 210) which the photonic crystal structure 720 can block. Therefore, in the antenna device according to the fourth embodiment, by forming the throughhole 105 and the hole 709 to have different arrangement patterns, a frequency band of the photonic band gaps 210 of each of the photonic crystal structure 710 and the photonic crystal structure 720 is adjusted to the frequency band of waves used by the antenna device. As a result, the antenna device according to the fourth embodiment can improve isolation between the transmission antenna and the receiving antenna.

It should be noted that it has been shown that the radius r2 of the hole 709 is longer than the radius r1 of the throughhole 105, but the radius r2 of the hole 709 may be shorter than the radius r1 of the throughhole 105. Furthermore, although it has been described to form the throughhole 105 and the hole 709 to have different radius, it is also possible to form the throughhole 105 and the hole 709 to have different arrangement space a, without making a difference in the radius. Still further, it is also possible to form the throughhole 105 and the hole 709 to have different radius and also different arrangement space a. Still further, it has been shown that shapes of both of the throughhole 105 and the hole 709 are the same, but the shape may be different between the throughhole 105 and the hole 709. For example, one of the throughhole 105 and the hole 709 may have an ellipse shape or a polygonal shape.

Moreover, when the conductor 407 is formed on the surface of the substrate 103 as shown in FIGS. 5A and 5B, it is possible to form, in the top surface conductor 407, a photonic crystal structure having an arrangement pattern different from the arrangement pattern of the photonic crystal structure formed on the substrate 103. Further, arrangement patterns of the photonic crystal structures formed in the top surface conductor 407, the substrate 103, and the ground conductor 104 may be different from one another.

Fifth Embodiment

In the antenna device according to the fifth embodiment, each of the fillings in the throughholes forming the photonic crystal structure protrudes from a surface of the substrate.

Figure 9A:
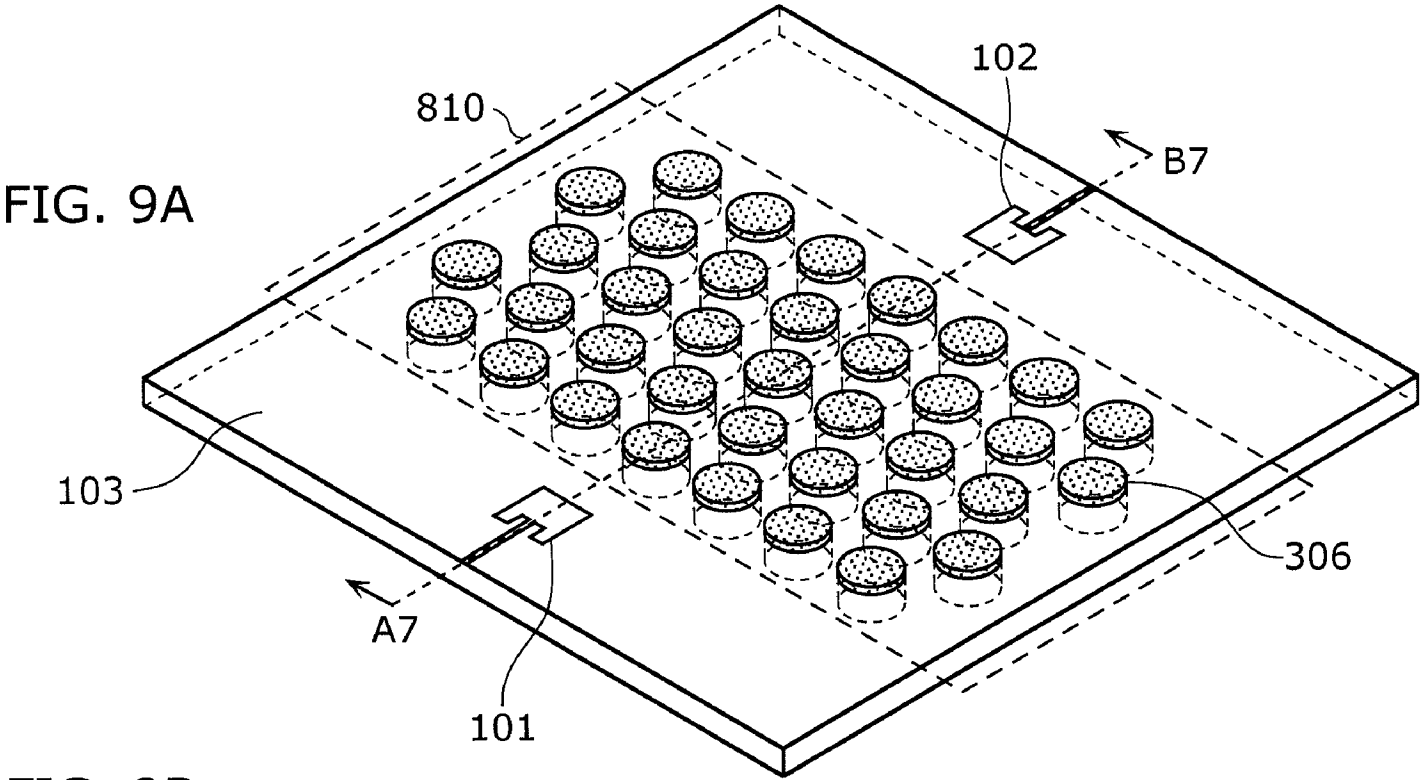
FIG. 9A is a perspective view of an antenna device according to the fifth embodiment.
Figure 9B:
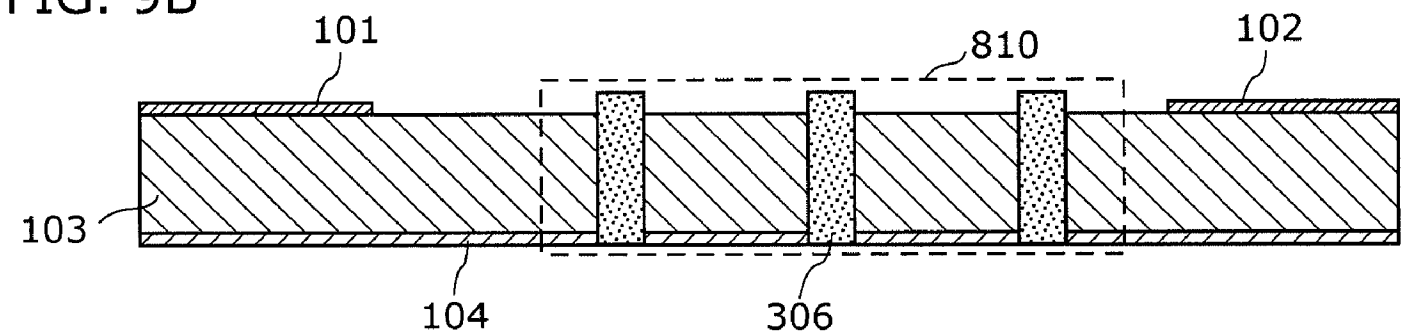
FIG. 9B is a cross sectional view taken along line A7-B7 of FIG. 9A.

FIG. 9A is a perspective view showing a structure of the antenna device according to the fifth embodiment. FIG. 9B is a cross sectional view taken along line A7-B7 of FIG. 9A. Here, the same reference numerals of FIGS. 4A and 4B are assigned to identical elements of FIGS. 9A and 9B, so that the detailed explanation for the identical elements is not given again below.

As shown in FIGS. 9A and 9B, the antenna device according to the fifth embodiment differs from the antenna device according to the second embodiment in that each of fillings with which each of the throughholes 306 is filled protrudes from a surface of the substrate 103.

With the above structure, the antenna device according to the fifth embodiment can block waves leaked above the surface of the substrate.

Sixth Embodiment

The antenna device according to the sixth embodiment can improve isolation between the transmission antenna and the receiving antenna, by removing a part of the ground conductor 104 between the transmission antenna and the receiving antenna.

Figure 10A:
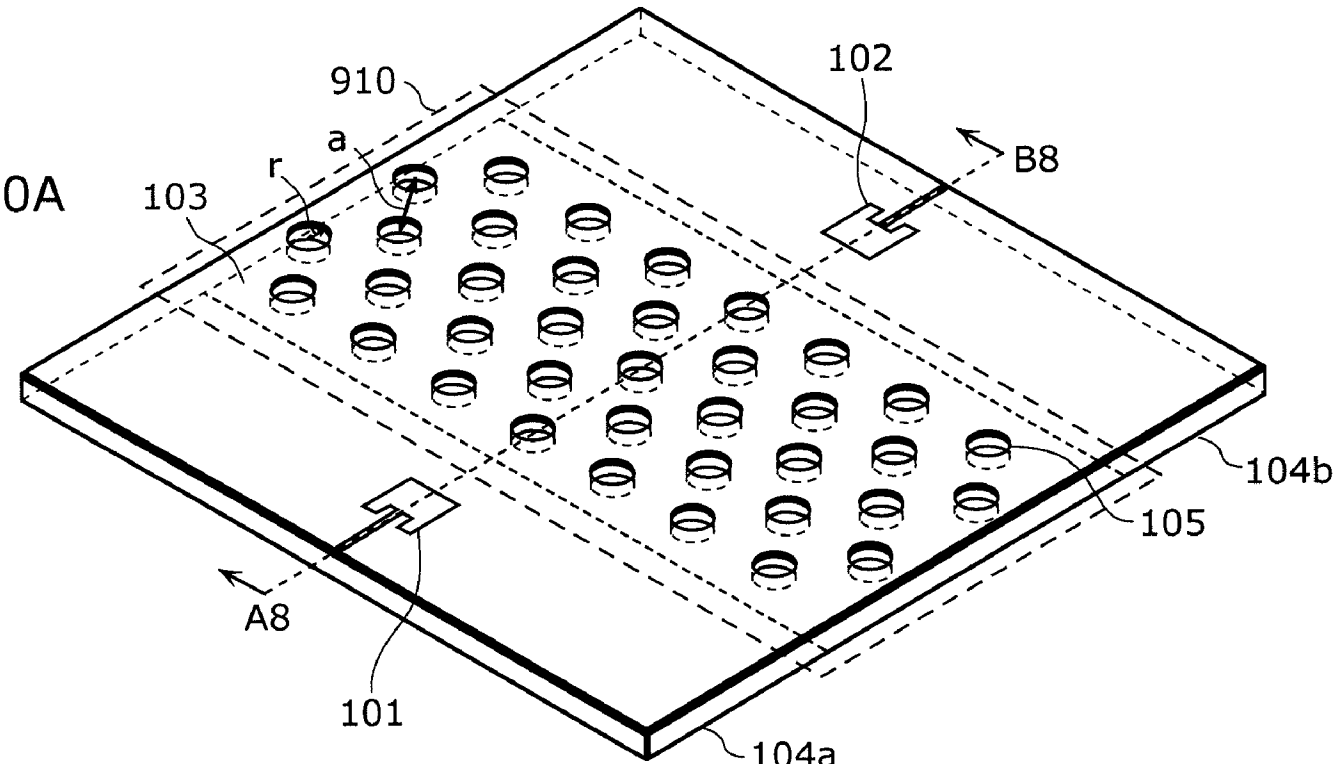
FIG. 10A is a perspective view of an antenna device according to the sixth embodiment.
Figure 10B:
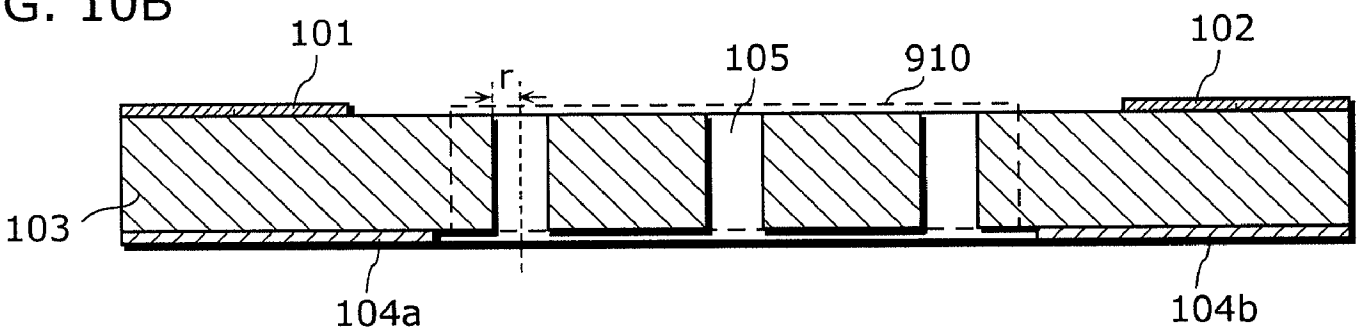
FIG. 10B is a cross sectional view taken along line A8-B8 of FIG. 10A.

FIG. 10A is a perspective view showing a structure of the antenna device according to the sixth embodiment. FIG. 10B is a cross sectional view taken along line A8-B8 of FIG. 10A. Here, the same reference numerals of FIGS. 2A and 2B are assigned to identical elements of FIGS. 10A and 10B, so that the detailed explanation for the identical elements is not given again below.

As shown in FIGS. 10A and 10B, the antenna device according to the sixth embodiment differs from the antenna device according to the first embodiment in that a part of the ground conductor between the transmission antenna 101 and the receiving antenna 102 is removed. The antenna device according to the sixth embodiment includes ground conductors 104*a* and 104*b*, instead of the ground conductor 104 which is formed on an entire rear surface of the substrate 103 in the first to fifth embodiments. In other words, the ground conductor 104 of the sixth embodiment has a gap between the transmission antenna 101 and the receiving antenna 102. Furthermore, the ground conductor 104*a* and the ground conductor 104*b* are arranged with a gap being positioned therebetween.

The ground conductor 104*a* is formed on a region of a rear surface of the substrate 103. On the top surface of the substrate 103, the transmission antenna 101 is formed on a region corresponding to the above region. The ground conductor 104*b* is formed on another region of the rear surface of the substrate 103. On the top surface of the substrate 103, the receiving antenna 102 is formed on a region corresponding to the above region.

Most of the waves leaked between the transmission antenna and the receiving antenna are propagated through the ground conductor on the rear surface. Therefore, by separating the ground conductor into a ground conductor corresponding to the transmission antenna 101 and a ground conductor corresponding to the receiving antenna 102, it is possible to reduce the wave leakage between the transmission antenna 101 and the receiving antenna 102.

Figure 11:
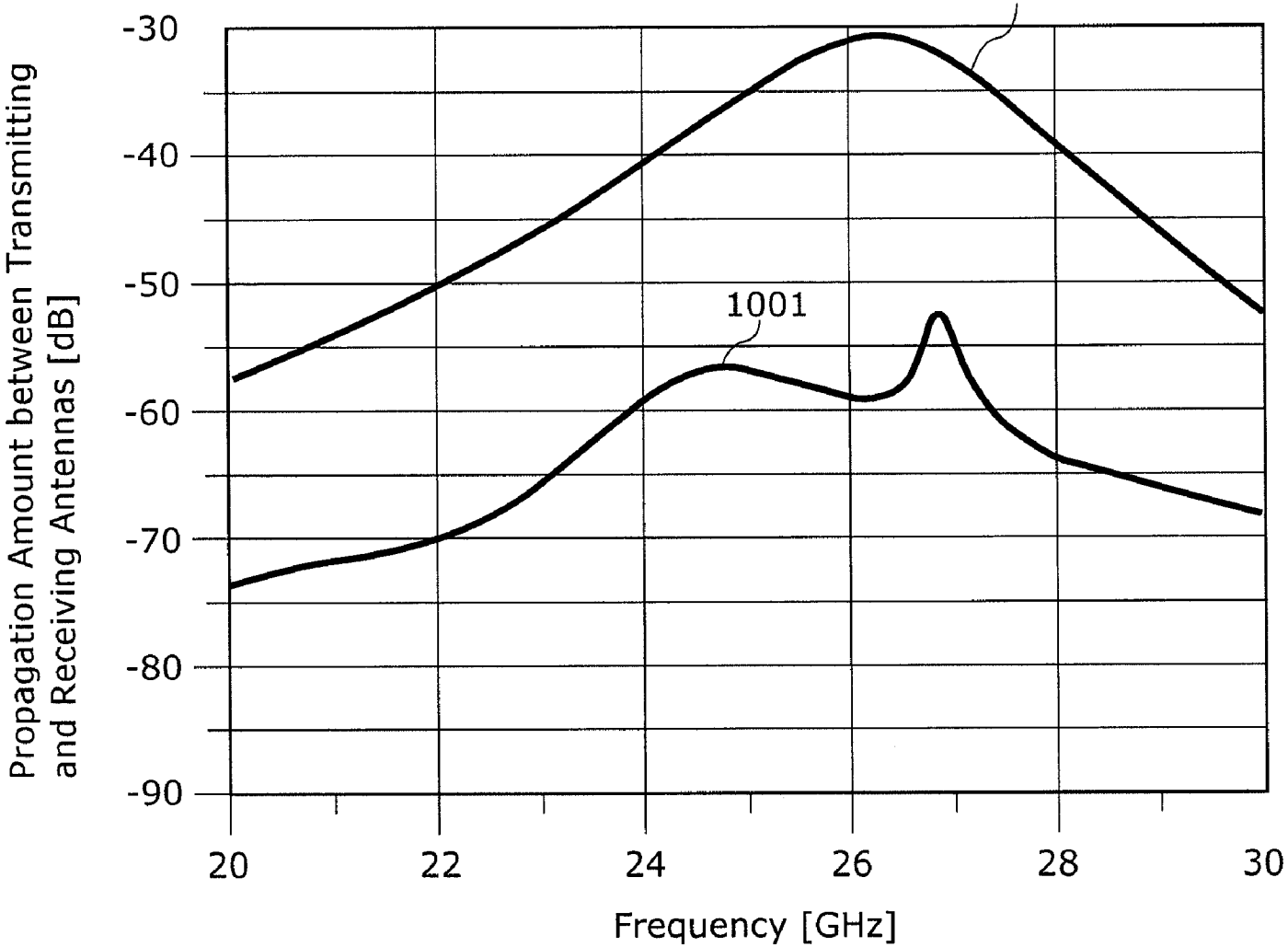
FIG. 11 is a graph plotting a propagation amount of leaked waves versus a frequency.

FIG. 11 is a graph plotting a propagation amount of the waves leaked between the transmission antenna and the receiving antenna versus a frequency of waves used by the antenna device. A waveform 1001 shown in FIG. 11 represents a propagation amount of waves between the transmission antenna and the receiving antenna, in the case where, in FIGS. 10A and 10B, a relative permittivity of the substrate 103 is 3.02, a radius r of the throughhole 105 is 1.8 mm, an arrangement space a of the throughhole 105 is 4.5 mm, a space between the transmission antenna 101 and the receiving antenna 102 is 30 mm, an isolation region of each of the ground conductors 104*a* and 104*b* is 20 mm, and a size of each patch antenna element in the transmission antenna 101 and the receiving antenna 102 is 3.1-mm-square. On the other hand, a waveform 1002 shown in FIG. 11 represents a propagation amount of waves between the transmission antenna and the receiving antenna, in the conventional case where the photonic crystal structure is not formed and the ground conductor 104 is arranged on an entire rear surface of the substrate 103. As shown in FIG. 11, around a frequency 26 GHz, between the transmission antenna and the receiving antenna, an amount of propagation waves having the waveform 1001 becomes smaller by about 30 dB, in comparison with the waveform 1002. In addition, for frequencies from 20 GHz to 30 GHz, between the transmission antenna and the receiving antenna, an amount of propagation waves having the waveform 1001 becomes smaller by about 17 dB on an average, in comparison with the waveform 1002. As obvious form the above, the antenna device according to the sixth embodiment can achieve very good isolation between the transmission antenna and the receiving antenna. Furthermore, if the ground conductor is separated into plural ground conductors set apart from each other without forming the photonic crystal structure (not shown), it is possible to reduce the propagated waves between the transmission antenna and the receiving antenna by about 10 dB. Still further, in the case of the antenna device in which the photonic crystal structure 110 is formed without the separation of the ground conductor 104 as shown in FIGS. 2A and 2B, it is possible to reduce the propagated waves between the transmission antenna and the receiving antenna by about 8 dB.

With the above structure, the antenna device according to the sixth embodiment can improve the isolation between the transmission antenna and the receiving antenna, by separating the ground conductor 104 into plural ground conductors formed on a rear surface corresponding to the transmission antenna 101 and on a rear surface corresponding to the receiving antenna 102, respectively.

It should be noted that a photonic crystal structure 901 is shown in FIGS. 10A and 10B, but it is possible to separate the ground conductor 104 into plural ground conductors set apart from each other without forming the photonic crystal structure 910.

Seventh Embodiment

The antenna device according to the seventh embodiment can improve isolation between the transmission antenna and the receiving antenna, by embedding a wave absorber between the transmission antenna and the receiving antenna.

Figure 12A:
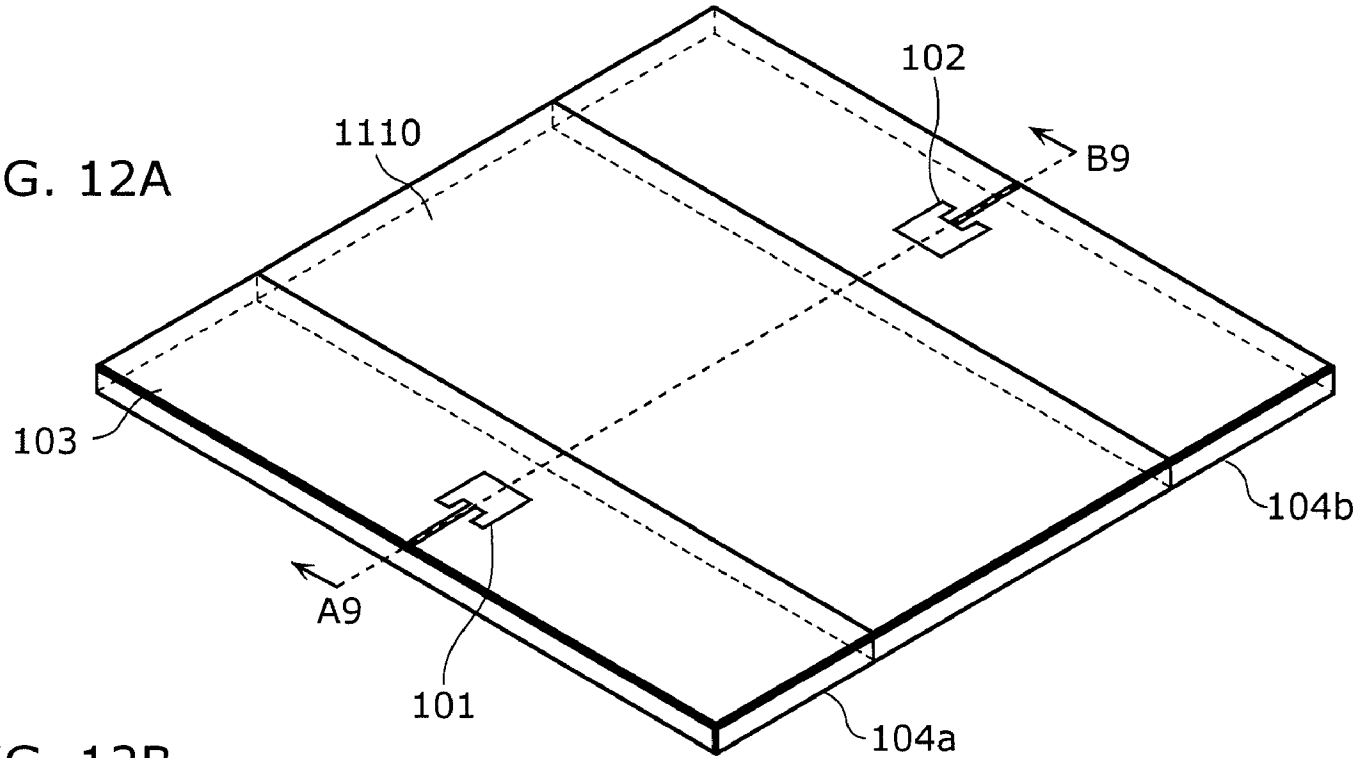
FIG. 12A is a perspective view of an antenna device according to the seventh embodiment.
Figure 12B:
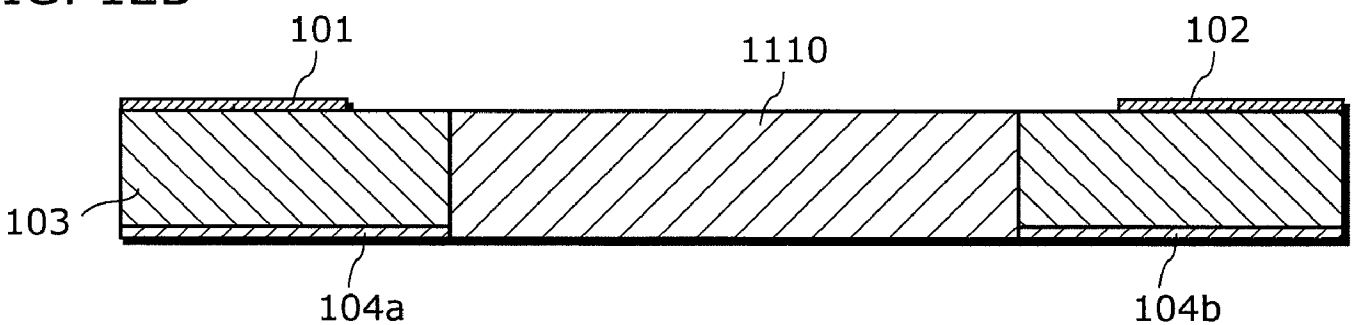
FIG. 12B is a cross sectional view taken along line A9-B9 of FIG. 12A.

FIG. 12A is a perspective view showing a structure of the antenna device according to the seventh embodiment. FIG. 12B is a cross sectional view taken along line A9-B9 of FIG. 12A. Here, the same reference numerals of FIGS. 2A and 2B are assigned to identical elements of FIGS. 12A and 12B, so that the detailed explanation for the identical elements is not given again below.

As shown in FIGS. 12A and 12B, in the antenna device according to the seventh embodiment, a wave absorber 1110 is formed between the transmission antenna 101 and the receiving antenna 102. In the antenna device according to the seventh embodiment, the wave absorber 1110 is embedded in a region where the photonic crystal structure 110 is formed in the first embodiment. For example, the substance of the wave absorber 1110 converts waves into heat using a carbon resistance loss, a magnetism loss of ferrite or the like.

With the above structure, the antenna device according to the seventh embodiment can improve isolation between the transmission antenna and the receiving antenna, since waves leaked between the transmission antenna and the receiving antenna are absorbed and then converted into heat by the wave absorber 1110.

The antenna devices according to the sixth and seventh embodiments, the ground conductor 104*a* formed on a rear side corresponding to the transmission antenna 101 and the ground conductor 104*b* formed on a rear side corresponding to the receiving antenna 102 are completely separated from each other. However, the ground conductors 104*a* and 104*b* may be connected via a line.

Figure 13A:
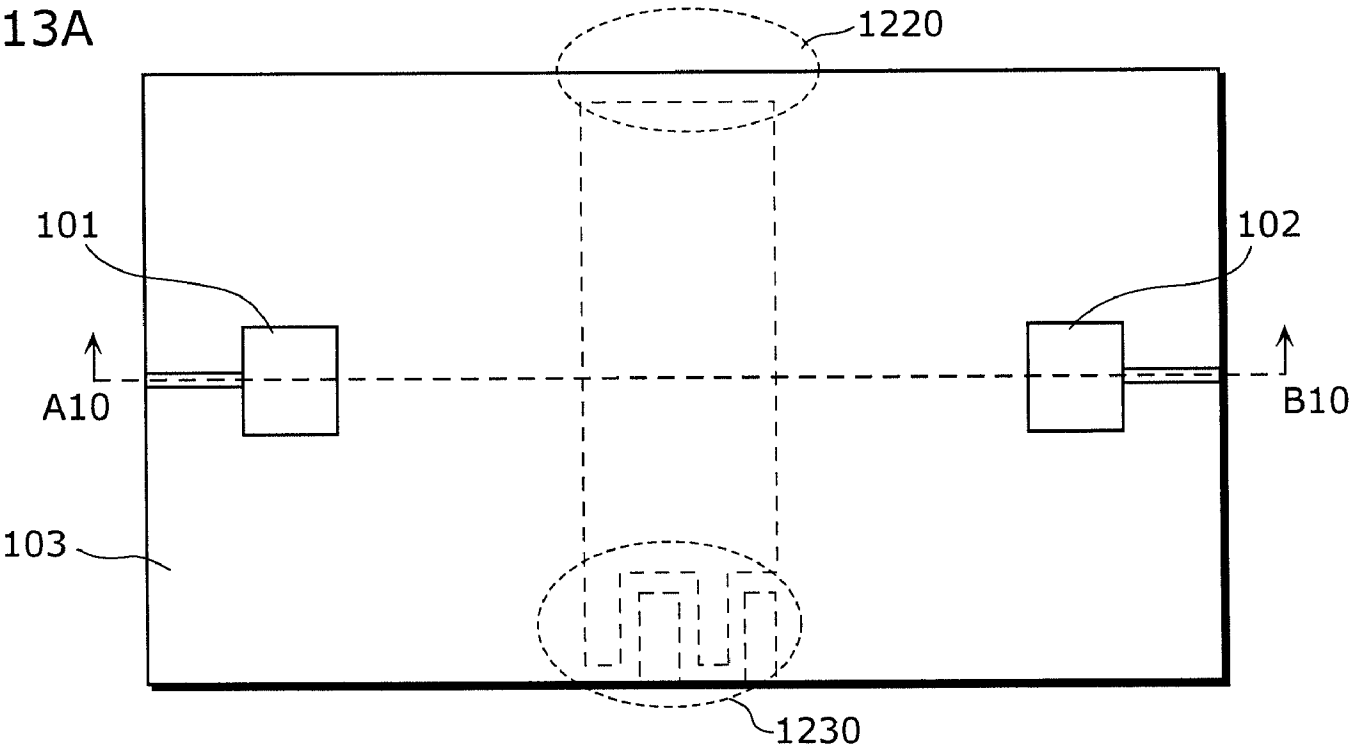
FIG. 13A is a plane view of an antenna device in which separated ground conductors are connected to each other via a line.
Figure 13B:
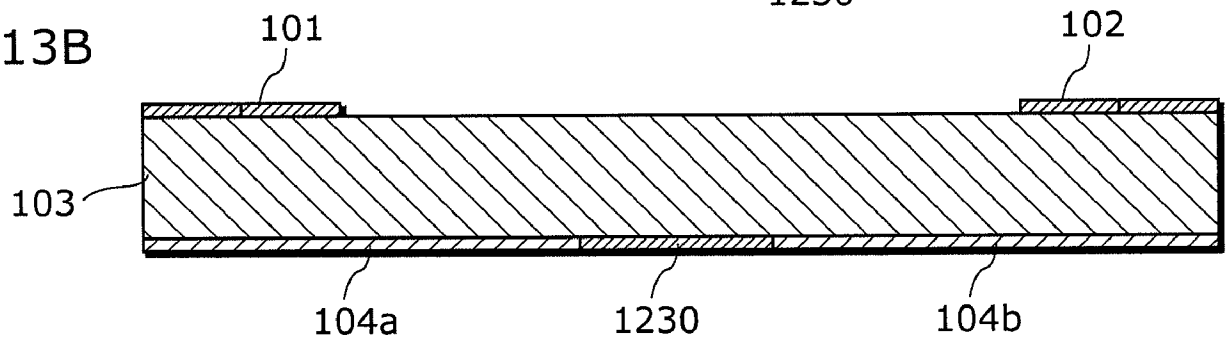
FIG. 13B is a cross sectional view taken along line A10-B10 of FIG. 13A.

FIG. 13A is a plane view of an antenna device in which ground conductors are connected to each other via a line. FIG. 13B is a cross sectional view taken along line A10-B10 of FIG. 13A. For example, as shown in FIGS. 13A and 13B, it is possible to form a connection line which electrically connects the ground conductor 104*a* to the ground conductor 104*b*. Furthermore, as shown in FIGS. 13A and 13B, it is also possible to form a connection serpentine line, which has serpentines, to connect the ground conductor 104*a* to the ground conductor 104*b*. By using the connection serpentine line 1230, a propagation distance of the leaked waves can be extended. In other words, by using the connection serpentine line 1230, the waves leaked between the transmission antenna and the receiving antenna through the connection line can be reduced more than the case of using the connection line 1220 which is a straight line.

INDUSTRIAL APPLICABILITY

The present invention can be used as an antenna device, and more specifically as a high-efficiency wireless communication device or a radar device.

The invention claimed is:

1. An antenna device comprising:

a first antenna element formed on a surface of a substrate, said first antenna element transmitting waves of a frequency;

a second antenna element formed on the surface of said substrate, said second antenna element receiving waves of the frequency;

an input signal line connected to the first antenna element;

an output signal line connected to the second antenna element;

a ground conductor formed on a rear surface of said substrate; and a photonic crystal structure formed between said first antenna element and said second antenna element, wherein said photonic crystal structure is made of a plurality of throughholes arranged in said substrate, a substance of said substrate, and a substance different from the substance of said substrate, the substance different from the substance of said substrate is formed in said plurality of throughholes, said photonic crystal structure has a photonic band gap corresponding to the frequency, and said photonic crystal structure blocks the waves of the frequency transmitted by said first antenna element and the waves of the frequency received by said second antenna element.

2. The antenna device according to claim 1, further comprising a top surface conductor formed on a surface of said substrate between said first antenna element and said second antenna element, wherein said top surface conductor is electrically connected to ground, and said plurality of throughholes penetrate said top surface conductor.

3. The antenna device according to claim 1, wherein the substance different from the substance of said substrate is a wave absorber made of a magnetic substance.

4. The antenna device according to claim 1, wherein a dielectric loss tangent of the substance different from the substance of said substrate is greater than a dielectric loss tangent of the substance of said substrate.

5. The antenna device according to claim 1, wherein a gap is formed in said ground conductor between said first antenna element and said second antenna element, and said ground conductor includes:

a first ground conductor formed on a first region of the rear surface of said substrate, said first antenna element being formed over the first region; and a second ground conductor formed on a second region of the rear surface of said substrate, said second antenna element being formed over the second region, and the second ground conductor being independent from the first ground conductor, wherein the gap is formed between said first ground conductor and said second ground conductor.

6. The antenna device according to claim 5, wherein said ground conductor includes:

a connection line electrically connecting said first ground conductor to said second ground conductor, wherein said connection line is a serpentine line formed on the rear surface of said substrate.

7. The antenna device according to claim 1, wherein the substance different from the substance of said substrate is filled in said plurality of throughholes and protrudes from the surface of said substrate on which the first and second antenna elements are formed.

* * * * *